US005287075A

United States Patent [19]

Regnaudin et al.

[11] Patent Number: 5,287,075

[45] Date of Patent: Feb. 15, 1994

[54] MICROWAVE PHASE SHIFTER

[75] Inventors: Francois Regnaudin; Michel Cauterman, both of Saint-Cloud, France

[73] Assignee: Electronique Serge Dassault, Saint-Cloud, France

[21] Appl. No.: 177,575

[22] Filed: Apr. 7, 1988

[30] Foreign Application Priority Data

Apr. 7, 1987 [FR] France ..... 87 04903

[51] Int. Cl.[5] ..... H01P 1/18

[52] U.S. Cl. ..... 333/158; 333/157; 333/164

[58] Field of Search ..... 333/158, 157, 164

[56] References Cited

U.S. PATENT DOCUMENTS

| | | | |
|---|---|---|---|
| 3,736,535 | 5/1973 | Mohr et al. | 333/158 |
| 4,254,383 | 7/1984 | Wolfe | 333/157 |
| 4,458,218 | 7/1984 | Babbitt et al. | 333/158 |
| 4,675,628 | 6/1987 | Rosen | 333/164 |
| 4,816,787 | 3/1989 | Stern et al. | 333/158 |

*Primary Examiner*—David C. Cain
*Attorney, Agent, or Firm*—Herbert Dubno

[57] ABSTRACT

In a reciprocal microwave phase shifter of microstrip technology, a Ferrite substrate carries, on one side, a ground plane (PM) and, on the other, a microstrip line (LM). The lateral branches (CG2 and CD2) cooperating with a base (CC) to define a magnetic circuit come into direct contact with the Ferrite substrate (SF), be being, for example, equipped with a recess (ED2) in line with the passage of the microstrip line (LM).

18 Claims, 4 Drawing Sheets

CD
CC
LM
SF
PM
CG

CD
SF
LM
CG

LM
SF
PM

CD2
ED2
SF
LM
CC
PM
SF
CG2
EG2

ED2
CD2
LM
CC
EG2
CG2

CG2
LM
SF
CC
MD2
PM
ED2

MICROWAVE PHASE SHIFTER

The invention relates to microwave phase shifters.

They are used, in particular, to adjust individually the phase laws applied to the elements of a grid antenna, with a view to obtaining, for example, an electronic scanning.

One end of the phase shifter is on the side of the grid antenna; its other end is on the side of microwave electronic emission and/or reception circuits. The phase shifter is "reciprocal" if it operates as well in the direction from the electronic system to the antenna (emission) as in the direction from the antenna to the electronic system (reception).

Modern phase shifters are constructed in accordance with the technology referred to as "microstrip line". Their substrate is a flat bar of Ferrite material (for brevity, ferrite) carrying on its lower face a conductive ground plane and on it supper face the microstrip conductive line per se.

The phase shift is obtained by modifying the effective permeability of the ferrite and, consequently, the velocity of propagation of the microwave signal in the phase shifter. To this end, the intensity of magnetization within the ferrite is caused to vary by means of an external magnetic circuit referred to as a "command circuit".

Phase shifters having a divided command circuit are described in the Patent Publication FR-A-2,580,429.

In the known devices, the command circuit excites the Ferrite substrate through the ground plane of the microstrip line. This leads to the avoidance of undesirable effects between the magnetic circuit and the microstrip line.

However, the magnetic circuit then, necessarily, includes two air gaps, which are traversed by the ground plane and in which the latter defines, in addition, two turns in short-circuit.

It results from this that the switching time obtained with such a command circuit cannot fall below a minimum value, of the order of 50 microseconds. Furthermore, there is a high thermal dissipation, by Foucault currents, in the course of the switching operations.

The present invention provides a solution to this problem.

To this end, use is made of a microwave phase-shifter device, of the type comprising a transmission-line structure of the microstrip type, comprising a dielectric bar of variable magnetic permeability, equipped, on one face, with a ground plane, and, on the other, with a microstrip conductive line per se, as well as at least one magnetic command circuit equipped with a winding and interacting with the bar.

According to a general feature of the invention, this magnetic circuit comes into direct contact with the bar, without the interposition of a conductive surface.

Surprisingly, the Applicant has, in fact, observed that it was possible to form this direct contact while avoiding the undesirable effects between the magnetic circuit and the microstrip line, which a person skilled in the art feared up to the present time.

It appears necessary to take various precautions in order to ensure the proper operation of the device. It is not possible, at the present time, to define these precautions, exhaustively, or in a definite manner.

However, it seems to be important that the contact surfaces between the magnetic circuit and the bar should be smoothed, plane and polished.

It is likewise desirable that the magnetic circuit should be designed to generate a homogeneous intensity of magnetization within the bar.

According to a first embodiment, at least a part of the command circuit comes into contact with the bar on the side of its microstrip line.

In this case, it is particularly advantageous that the command circuit is equipped with a recess in line with the microstrip line. Even better, this recess, being metallized, forms together with the microstrip line a coaxial line with continuity of impedance. A similar mode of operation may be obtained by accommodating within the recess an attached coaxial line, the core of which is connected to the microstrip line, which is then restricted within the delimited zone, on the surface of the bar, by the magnetic circuit.

According to a further embodiment, which is not incompatible with the first, at least a part of the command circuit comes into contact with the bar on the side of the ground plane, at locations where the latter is interrupted.

The microstrip line itself may retain its customary rectilinear form.

According to a variant, applicable to the various embodiments of the invention, the terminals of the microstrip line are implanted laterally in relation to the longitudinal plane of the command circuit.

A further variant of the invention consists in that the device comprises two command circuits disposed on either side of the bar.

For its part, the microstrip structure may be designed in accordance with the technology referred to as "triplate".

In this case, the two command circuits may be disposed on the same side of the bar.

For its part, the microstrip line may be constructed by direct metallization of the bar.

In this regard, the bar may be made of massive microwave Ferrite material. It may also comprise a stack of dielectric material, at least one of which is then formed from microwave Ferrite material.

In a similar way, the microstrip line may also itself be covered with a dielectric layer. The latter being metallized, the result of this is then the triplate structure. In the case where two magnetic circuits are employed, the covering dielectric comprises microwave ferrite material.

Finally, at least one of the materials of the command circuit on the one hand and of the bar on the other hand is advantageously remanent, in order that a command pulse applied to the winding should produce permanent effects, so far as concerns the desired phase shift.

Further features and advantages of the invention will become evident on examining the detailed description given hereinbelow and the accompanying drawings, in which.

The accompanying drawings include elements which are geometric and/or of a definite nature. Consequently, they may not only serve to provide a better understanding of the detailed description given hereinbelow, but also contribute to the definition of the invention, as appropriate.

In the figures, a bar or substrate of microwave Ferrite has been generally designated by SF. What is involved here is the material which is well known to persons skilled in the art for the construction of reciprocal phase shifters.

Figures 1A, 1B, 1C, 2A, 2B, 2C:
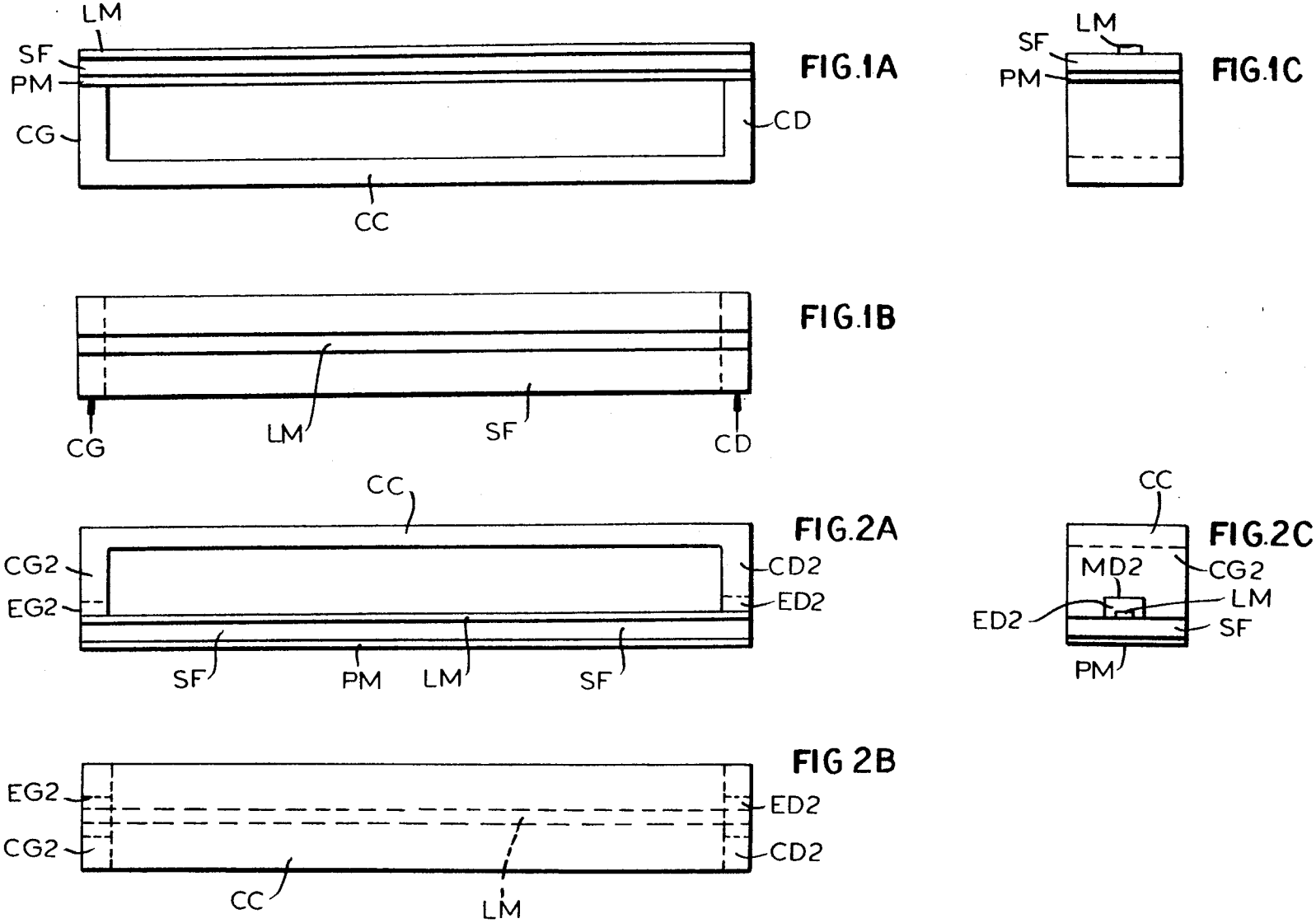
FIGS. 1A to 1C show a device according to the prior art.
FIGS. 2A to 2C show a first device according to the invention.

On one side of the bar SF a microstrip line LM is provided, which is rectilinear in FIGS. 1A to 1C. On the other side a ground plane is provided, which covers all, or almost all, of the lower face of the bar.

The shapes of the elements of the drawings are easily identifiable, since each plate includes three corresponding views, in accordance with the conventions of French technical drawings.

A known microwave phase shifter (FIGS. 1) comprises, on the side of the ground plane, a magnetic circuit defined by a base or yoke CC, carrying a winding (now shown, for the sake of simplicity), and two lateral branches CG, on the left, and CD on the right, the assembly extending perpendicularly to the ground plane.

This arrangement presents the advantage of avoiding any undesirable effect, on the microstrip line, on account of the currents circulating within the command winding.

It presents the difficulty, already stated, that parts of the ground plane are interposed between the magnetic circuit and the ferrite bar SF, of which it is necessary to cause the magnetic permeability to vary. This leads to losses due to Foucault currents, and makes it impossible to obtain very short switching times.

This is all the more so, in circumstances in which one of the elements concerned, the bar itself or at least a part of the command circuit, possesses the remanence desired for a command by pulses.

In a first embodiment of the invention (FIGS. 2), the command circuit is located in the upper part, that is to say on the side of the microstrip line LM.

The branches CG2 and CD2 of the magnetic circuit are equipped with recesses EG2 and ED2.

As can be seen in FIG. 2C, these recesses are sufficiently broad to reduce the effect of the magnetic circuit on the microstrip line LM.

Preferably, a metallization MD2 is provided on the external contour of the recess such as ED2, in the branch CG2 of the magnetic circuit.

A variant, which is not shown, consists in attaching within the recess a coaxial line, the core of which traverses the recess, and the screening of which comes close to the contour of this recess.

Figure 3A:
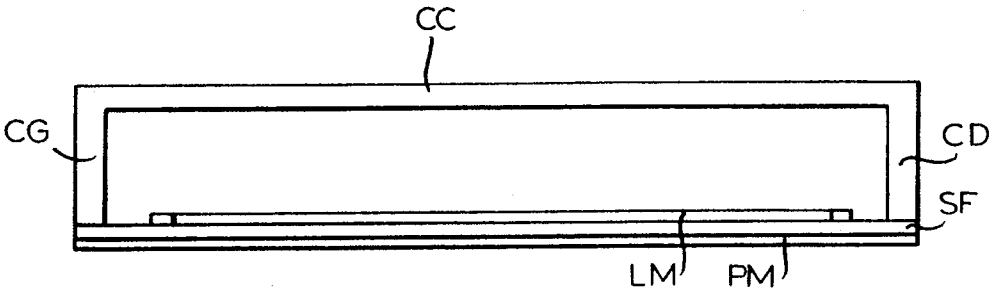
FIGS. 3A to 3C show a second device according to the invention.
Figure 3B:
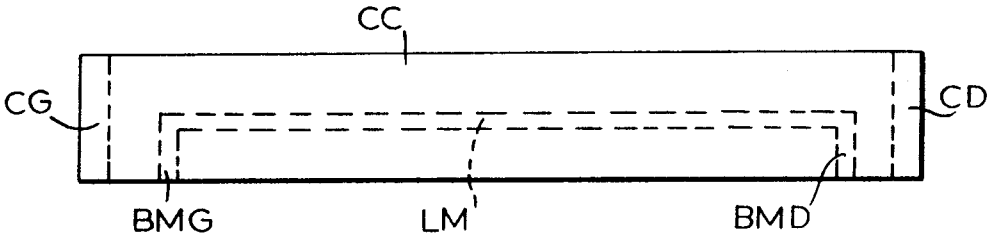
Figure 3C:
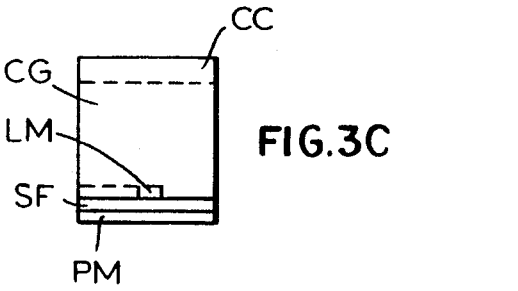

A further embodiment of the invention is illustrated in FIGS. 3. The branches CG and CD of the magnetic circuit do not have any recess, as in FIG. 1, although this magnetic circuit is on the side of the microstrip line LM.

Instead of passing out at the end of the bar SF, the microstrip line passes out via lateral terminals BMG and BMD, as can be seen in FIG. 3B.

Figure 4A:
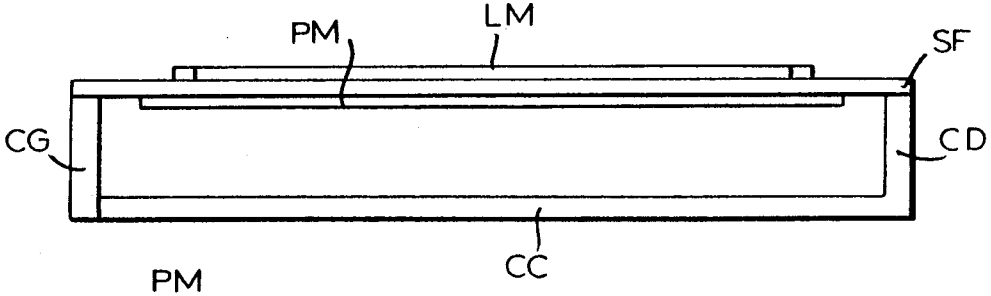
FIGS. 4A to 4C show a third device according to the invention.
Figure 4B:
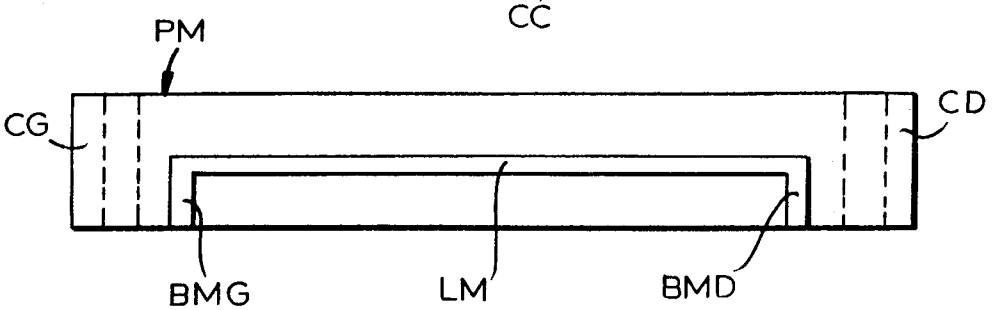
Figure 4C:
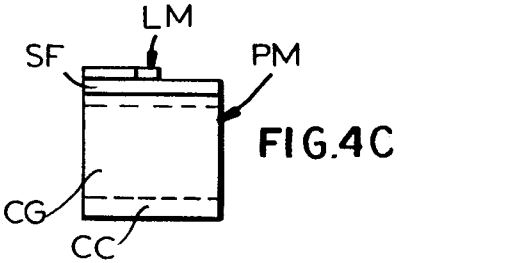

In FIGS. 4, the command circuit again does not have any recess, and remains on the side of the ground plane. However, the size of the ground plane is reduced in order that the command circuit should be in direct contact with the ferrite substrate SF.

In order to maintain the function of the ground plane in relation to the microstrip line, the latter passes out laterally via terminals BMG and BMD (FIG. 4B), which are contained between the two limiting vertical planes defined by the ground plane PM.

Figure 5C:
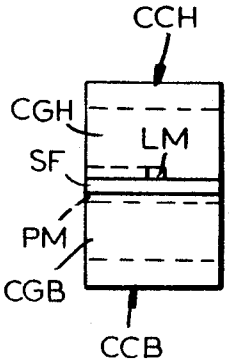
FIGS. 5A to 5C show a fourth device according to the invention.
Figure 5A:
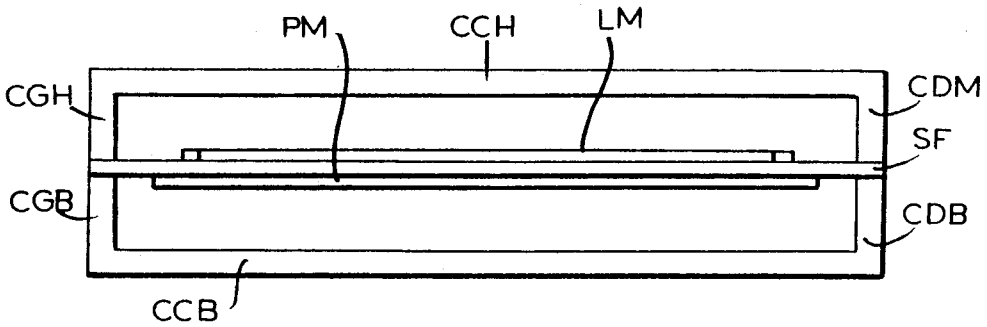
Figure 5B:
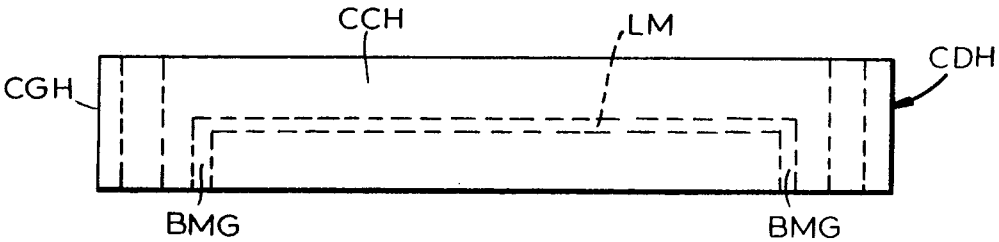

The structure of FIGS. 5 includes two magnetic command circuits, one situated at the top and the other at the bottom. The notation is the same as previously, with the suffix H for the top command circuit and the suffix B for that at the bottom.

The bottom circuit is connected as for FIGS. 4. That at the top is connected as for FIGS. 3.

Two triplate structures will now be described.

Figure 6C:
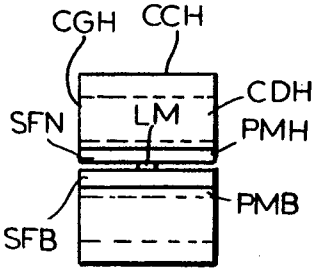
FIGS. 6A to 6C show a fifth device according to the invention.
Figure 6A:
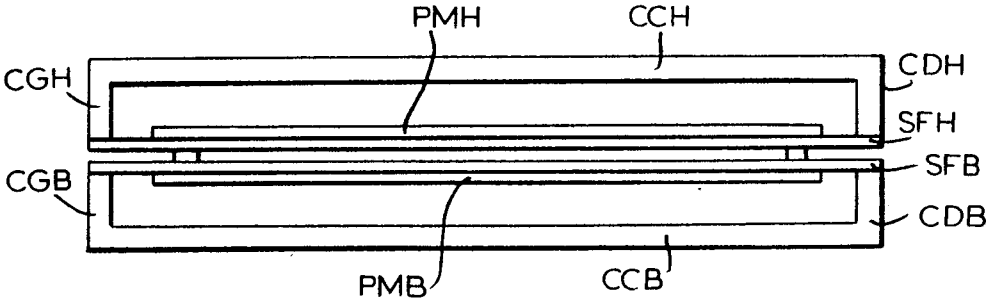
Figure 6B:
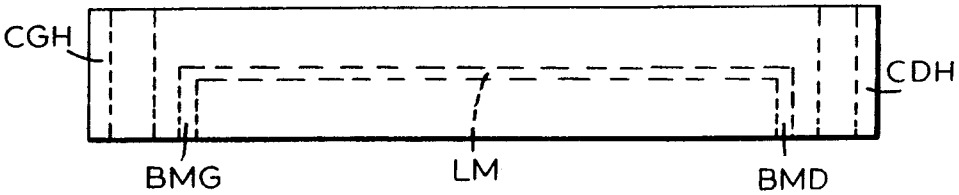

The triplate structure of FIGS. 6 is more symmetric.

A top ferrite substrate SFH and a bottom ferrite substrate SFB frame a microstrip line LM equipped with lateral terminals BMG and BMD. On either side, a top ground plane PMH and a bottom ground plane PMB extend over only a part of the surface of the bars SFH and SFB, respectively, at the outside.

The top magnetic circuit CCH and the bottom magnetic circuit CCB comes into contact with the bars outside the ground planes.

It will be readily be appreciated that this embodiment is obtained by doubling that of FIG. 4, about an axis of symmetry extending in the principal longitudinal direction of the microstrip line LM.

Figure 7C:
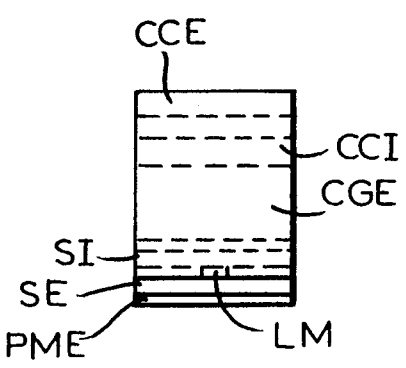
FIGS. 7A to 7C show a sixth device according to the invention.
Figure 7A:
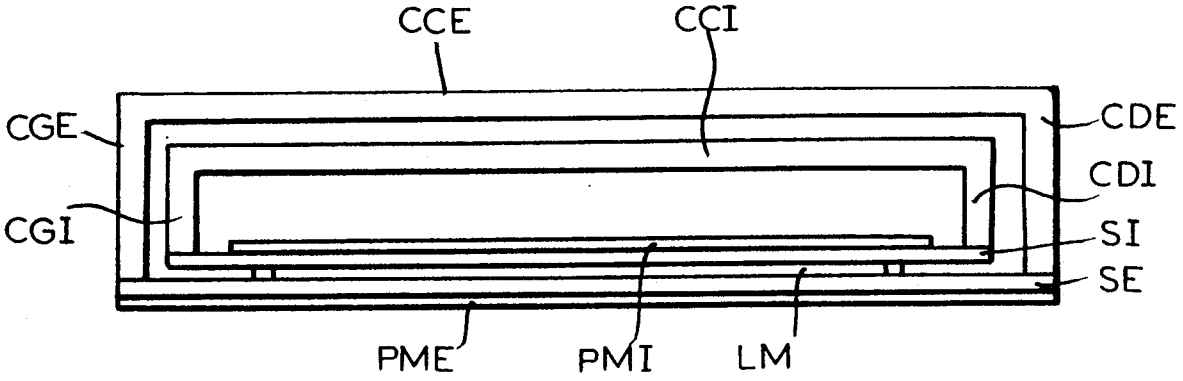
Figure 7B:
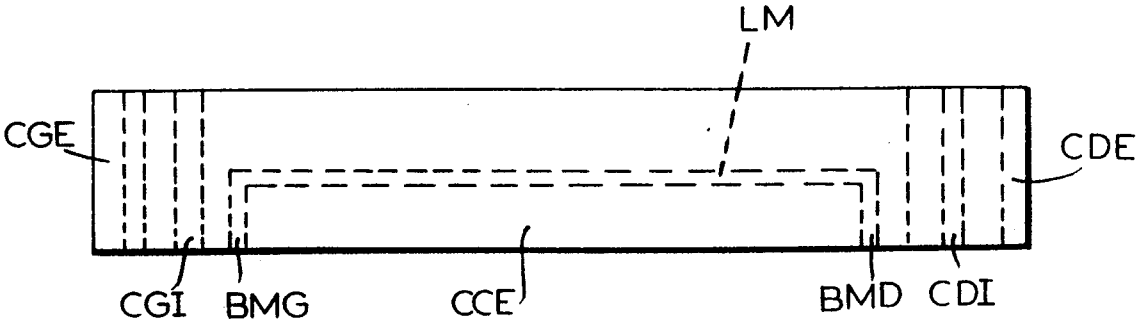

In FIGS. 7, the triplate structure is defined by an external ferrite substrate SE, and an internal ferrite substrate SI, which frame, in a sandwich, the microstrip line LM. The latter is equipped with lateral terminals BMG and BMD (FIG. 7B).

On either side of the bars SI and SE there are provided respectively an internal ground plane PMI, which does not cover the entire surface of the bar SI, and a ground plane PME, which may, on the other hand, cover the entire surface of the bar SE.

An external magnetic circuit (suffix E) is then defined with the upper part of the bar SE, i.e. on the side of the microstrip line, in accordance with FIG. 3.

An internal command circuit (suffix I) is defined with the internal bar SI, on the side of the ground plane PMI of this bar, which is reduced, in accordance with FIG. 4.

The present invention is certainly not limited to the described embodiments. It extends to any variant in conformity with the spirit thereof.

It will be observed, in particular, that the present invention is not incompatible with divided command circuits, such as described in the French Patent Publication FR-A 2,580,429, to which reference has already been made, in the name of the Applicant.

We claim:

1. Microwave phase-shifter device comprising a microstrip transmission-line structure having a dielectric bar of variable magnetic permeability and having first and second opposite faces, there being provided a ground plane on its first face and a microstrip conductive line on said second face, said phase-shifter device including at least one magnetic command circuit equipped with a winding which interacts with said bar, said magnetic circuit being in direct contact with said bar.

2. A device according to claim 1, wherein the magnetic circuit and the bar have respective contact surfaces therebetween, each said surface being smooth, plane and polished.

3. A device according to claim 1, wherein the magnetic circuit is adapted to generate a homogeneous intensity of magnetization within the bar.

4. A device according to claim 1, wherein the command circuit has at least a part thereof which contacts the bar on the side of the microstrip line.

5. A device according to claim 4, wherein the command circuit includes means defining a recess to receive the microstrip.

6. A device according to claim 5, wherein the means defining the recess is metallized to form with the microstrip line a coaxial line having impedance continuity.

7. A device according to claim 5, including a coaxial line having core which is connected to the microstrip line within the zone delimited by the magnetic circuit, said coaxial line being accommodated within said recess.

8. A device according to claim 1, wherein the command circuit has at least a part thereof which contacts the bar on the side of the ground plane at locations where the ground plane is interrupted.

9. A device according to claim 1, wherein the microstrip line has terminals that are implanted laterally in relation to the longitudinal plane of the command circuit.

10. A device according to claim 1, which comprises two said command circuits, said command circuits being disposed on opposite sides of the bar.

11. A device according to claim 1, wherein the microstrip structure has a triplate construction.

12. A device according to claim 11, which comprises two said command circuits, said command circuits being disposed on the same side of the bar.

13. A device according to claim 1, wherein the microstrip line is constructed by direct metallization of the bar.

14. A device according to claim 1, wherein said bar comprises a stack of dielectric layers, at one of said layers being formed from microwave Ferrite material.

15. A device according to claim 1, wherein the microstrip line is covered with a dielectric layer.

16. A device according to claim 15, wherein the microstrip line is covered with a metallized dielectric layer forming a triplate circuit.

17. A device according to claim 16, wherein the covering dielectric layer comprises microwave Ferrite material.

18. A device according to claim 1, wherein at least one of the materials of the command circuit, on the one hand, and of the bar, on the other hand, is lead back.

* * * * *